US005519975A

United States Patent [19]

Taylor et al.

[11] Patent Number: 5,519,975

[45] Date of Patent: May 28, 1996

[54] DRAINAGE ROOFING TILE

[76] Inventors: Mark Taylor; Laura B. Taylor, both of 7680 W. Chatfield Ave., Littleton, Colo. 80123

[21] Appl. No.: 315,611

[22] Filed: Sep. 30, 1994

[51] Int. Cl.[6] ..... E04D 1/00

[52] U.S. Cl. ..... 52/533; 52/543; 52/478; 52/746.11

[58] Field of Search ..... 52/533, 520, 521, 52/542, 543, 553, 478, 536, 538, 541, 560, 745.19, 746.1, 746.11, 747.1

[56] References Cited

U.S. PATENT DOCUMENTS

| | | |
|---|---|---|
| 38,931 | 12/1907 | Dickelman . |
| D. 57,865 | 5/1921 | Scharwath . |
| D. 338,541 | 8/1993 | Fifield . |
| D. 347,287 | 5/1994 | Mayer . |
| 465,364 | 12/1891 | Donaldson et al. . |
| 1,125,414 | 1/1915 | Vogan . |
| 1,226,888 | 5/1917 | Hughes et al. . |
| 1,999,244 | 3/1933 | Ludowici . |
| 4,432,183 | 2/1984 | Pike et al. . |
| 5,174,092 | 12/1992 | Naden . |
| 5,182,892 | 2/1993 | Chase . |
| 5,305,570 | 4/1994 | Rodriguez et al. . |

FOREIGN PATENT DOCUMENTS

| | | |
|---|---|---|
| 214988 | 3/1956 | Australia . |
| 874256 | 3/1941 | France . |
| 2-38651 | 7/1988 | Japan . |

*Primary Examiner*—Creighton Smith

[57] ABSTRACT

A molded roofing material tile that forms a five-sided rectangular box-like structure with a central support spine running on the underside of the tile from the back side to the front side, that permits virtually free drainage of sub-tile water through an elongated weep aperture running along the back side of the tile, thereby to drain water away that would otherwise deteriorate the tile and the underlayment. The tile has rabbeted sides that permit overlapping with side adjacent tiles laid in a roofing course. The tiles are fastened by conventional fasteners that run through reinforced fastener posts at the rear corners of the tile, and do not require application of special adhesive. No special alternative embodiment is required as an initial course of tile nearest the eaves of the building.

9 Claims, 2 Drawing Sheets

DRAINAGE ROOFING TILE

BACKGROUND OF THE INVENTION

This invention relates to improved roofing shingles or tiles, of the type that are laid over an underlayment in a series of rows on a roof, and in particular, relates to dimensional molded roofing tiles that do not accumulate water beneath them that can lead to premature roof material failure.

In conventional roofing systems, an underlayment comprising asphalt roofing felt is laid over a plywood underroofing. Wooden strips or battens are then laid in tranverse rows over the underlayment, and the roofing tiles are nailed, through nail holes provided in the tile, directly to the batten. Battens are generally one inch by two inch boards that are laid down in both horizontal and vertical courses of approximately twelve to sixteen inch intervals. Alternatively, the tiles are nailed directly through the asphalt underlayment to the plywood underroofing without using battens. The disadvantage posed by such construction methods is that the upper ends of dimensioned roofing tiles installed in such fashion tend to act as small water dams during rain. Furthermore, in cold climates, melting snow can likewise dam up on a dimensioned tile, and even worse, is subject to refreezing, which can cause even more material damage. Dimensioned roofing tiles, as opposed to less expensive asphalt-type roofing shingles, are thicker, being made of materials such as wood, concrete, terra cotta, ceramic, stamped metal and the like. Dimensioned tiles are chosen by architects and homeowners for their unique and distinctive exterior appearance and their longer lifetimes, compared to asphalt shingles. As water is dammed up on the relatively thick upper edges of such dimensioned tiles, it thus pools onto the underlayment, tending to lead to premature material failure. In those situations where nails are driven into the underlayment itself instead of into a batten, such pooled water is even more likely to be able to seep into the underlayment material. These retained-moisture situations tend to lead to premature failure of the roof tile material and of the underlayment.

Prior art solutions to this problem generally have included the provision of so-called weep holes at the top of a roofing tile that make allowance for water that would otherwise have dammed up at the top of the tile to more freely flow down under the courses of the tiles. See the disclosure of U.S. Pat. No. 4,432,183, issued Feb. 21, 1984 to Pike, et. al., and U.S. Design Pat. No. 347,287, issued May 24, 1994 to Mayer. One requirement of the prior art is that in order to minimize seepage into underlayment, even with the inclusion of weep holes, that tiles not be nailed into the underlayment, but rather into battens, and that adhesives be applied to at least part of the bottom surface of the tiles. See Pike U.S. Pat. No. 4,432,183. The requirement of battens adds to the cost of installing a roof, as does the necessity of applying an adhesive to a tile. Additionally, any system that uses a batten needs some provision for drainage through the batten itself, which can act as a water dam for the same reasons given above as for dimensioned roof tiles. Thus, it is an object of the present invention to provide for a roofing tile that does not require the application of adhesives or the installation of battens, while being able to minimize water damming at the tops of the tiles during rain and minimize water saturation and damage to underlayment and tile material itself.

Wooden shakes and shingle have been a popular roofing material in upscale homes, yet pose a serious fire hazard, especially in drier climates. They also present an additional fire hazard to the rest of the community, since, under certain windy conditions, hot embers from a blazing wooden roof can get blown onto neighboring roofs and likewise start them on fire. An additional object of the present invention is to provide for an alternative to the use of wooden shakes or shingles so as to mimimize the fire hazard potential of a roof, while affording the look of a wooden shake or shingle roof.

Prior art roofing tiles have typically been relatively heavy, with thick-walled construction that uses materials such as concrete not being unusual. Therefore, another object of the present invention is to provide for a roofing material that is relatively light in weight, yet is able to withstand a relatively heavy load.

Prior art roofing tiles have typically required the use of a slightly different embodiment of the tile for the first course of tiles that is laid down by the installer and that is closest to the eaves. Therefore, it is yet another object of the present invention to provide for a roofing system whose installation does not require an alternative embodiment for the installation of the initial course of tiles that is nearest the eaves.

The present invention achieves these objects by providing for a roofing tile that features molded construction of a suitable thermoplastic or thermosetting resin into the weight-saving shape of a box that achieves greater rigidity and weight bearing capacity through the inclusion of a central weight bearing rib; an elongated drainage slot in the upper portion that is a high efficiency water conduit; and that, by virtue of its design, does not require a different embodiment of the initial course that is laid down nearest the eaves. The advantages posed by the roofing tile of the present invention are easier installation by elimination of laying down battens or applying adhesives; reduced fire hazard; improved water drainage that acts to prolong material life; and lighter weight that reduces shipping costs and reduces the load-bearing requirements of the building structure.

SUMMARY OF THE INVENTION

In summary, the invention comprises a molded roofing tile, having a planar panel that has a face side and an under side, a bottom flange angularly juxtaposed adjacent said panel, a top flange angularly juxtaposed adjacent said panel, which top flange defines a single elongated drainage slot which is substantially parallel to the plane of said panel, a first side flange angularly juxtaposed adjacent said panel, which first side flange is molded so as to form an over fitting rabbet, a second side flange angularly juxtaposed adjacent said panel, which first side flange is molded so as to form an under fitting rabbet, a single support rib fixably attached to the under side of said panel, beginning substantially at said top flange and terminating substantially at said bottom flange, said tiles being laid out on a roof by being affixed by suitable mechanical fastening means to a suitable underlayment means in courses, each tile's over fitting rabbet being juxtaposed adjacent to and interlocking with an under fitting rabbet of an adjacent tile. Also within the present invention are a method of installing the above described tiles in order to install a roof that will resist moisture-induced material failure.

BRIEF DESCRIPTION OF THE DRAWINGS

FIG. 2 shows the tile flipped over from the view of FIG. 1), the support rib on the under side of the tile, the water drainage slot cut into the top flange of the tile, and the tile fastener support posts.

DETAILED DESCRIPTION OF THE PREFERRED EMBODIMENTS

Figure 1:
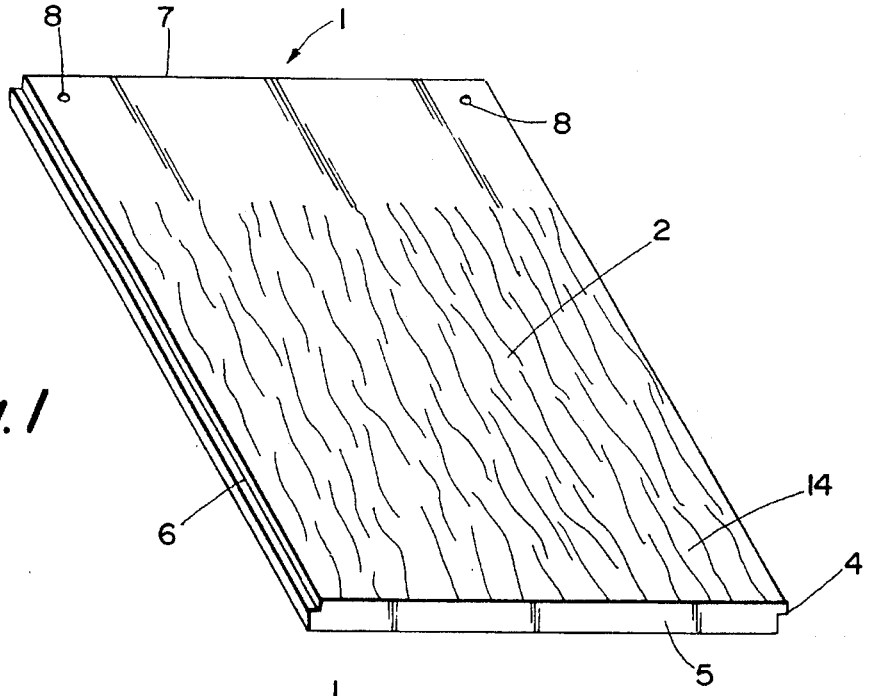
FIG. 1 is a perspective view of the top of a roofing tile of the present invention, showing the overall appearance of the tile, a simulated woodgrained texture on the face of the tile, an under fitting rabbet on the left hand side of the tile, and holes for suitable tile fasteners on the upper corners of the tile.
Figure 2:
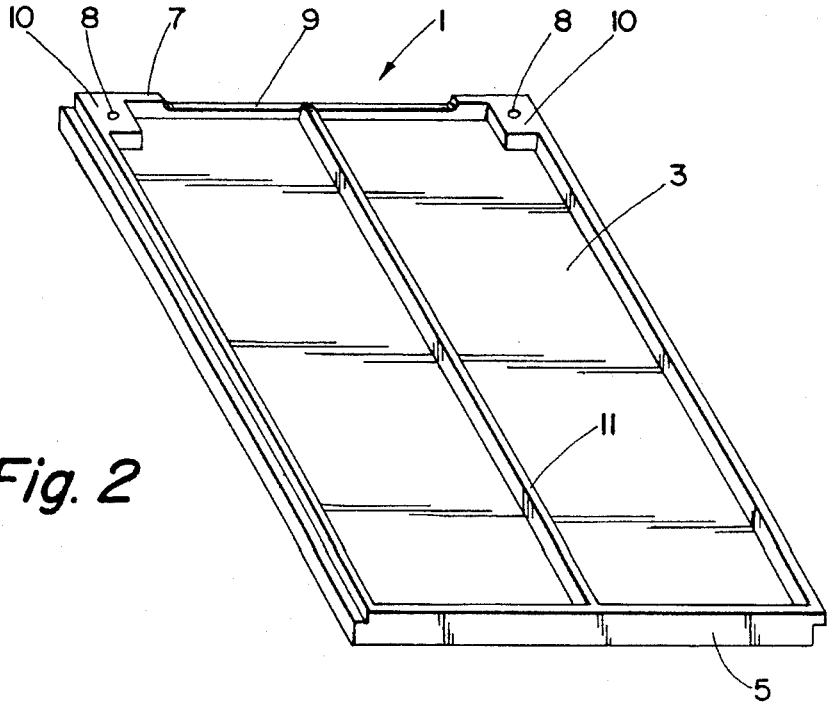
FIG. 2 is a perspective view of the bottom of the roofing tile, showing an over fitting rabbet on the right side of the tile (which appears on the left of the figure, since

The present invention, in its most preferred embodiment, is shown generally by 1 at FIGS. 1 and 2. The tile 1 has a top or face side 2, which can be looked at as being the largest panel of a box that has four other panels. The four other panels are bottom flange 5, top flange 7, a right side flange 4 and a left side flange 6. By reference to FIGS. 1 and 2 it can be seen that right side flange 4 forms an over fitting rabbet and left side flange 6 forms an under fitting rabbet. The terms over fitting rabbet and under fitting rabbet are relative terms that here mean that the two side flanges of the tile 1 are asymmetric, so that when tiles are laid side-by-side, they snugly interlock by virtue of one tiles' over fitting rabbet complementing and fitting over the adjacent tiles' under fitting rabbet, and vice versa. Thus, it is not important whether a tiles' over fitting rabbet is on the right or the left side of the tile, so long as the opposite side flange of the tile is formed into a complementary rabbet.

Figure 3:
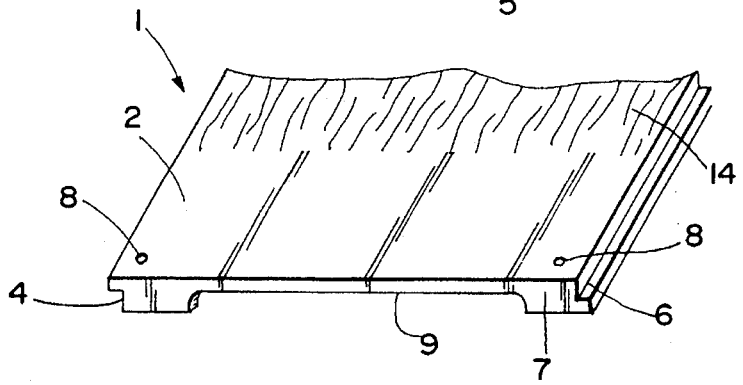
FIG. 3 is a partial perspective view showing the top flange of the tile.

In FIG. 2, the bottom view of the tile 1 shows the under side support rib 11. The rib 11 runs substantially down the center of the under side 3 of the tile 1. Rib 11 imparts structural strength to the tile by acting as a gusset that strengthens the angle between the elements panel 2, bottom flange 5 and top flange 7. In general, the width of rib 11 will be the same dimension as the width of the side flanges 4 and 6. The rib 11 can be, but is not necessarily, attached to the top flange 7. Also in FIG. 2 there is shown at 9 the water drainage slot. The slot preferably comprises at least 50% of the length of the top flange 7, and most preferably comprises at least 75% of the length of top flange 7. The slot 9 is milled or cut into top flange 7 such that there is no bottom lip on slot 9 to impede water flow through the top of tile 1. This is shown more clearly in FIG. 3.

Referring again to FIG. 2, there are shown at 10 the two corner fastener support posts, each having a bore running through their longitudinal axis that is of sufficient diameter to allow insertion of a selected mechanical fastener. The support posts add rigidity to the mechanical fasteners used to attach the roof tile, which will generally be suitable nails. The rigidity conferred on the structure of the tile by the support posts 10 eliminates the need for the use of adhesives in the installation of the roof tile.

Although the preferred embodiment of the roofing tile is substantially of uniform thickness from top to bottom, the tiles can be manufactured to have a tapering thickness, although such a taper will not affect the drainage function of the tiles.

A typical tile of a preferred embodiment of the invention will have dimensions of about twelve inches in width by fifteen inches in length, and an average thickness of about three fourths of an inch, although it is to be understood that these dimensions are representative only and do not limit the invention as claimed. In an alternative embodiment of the invention, the tiles can be constructed as panels with dimensions that approach two feet by four feet, two feet by five feet, three feet by four feet or even as large as four feet by eight feet. Such panels can be used to quickly cover a roof where the appearance of a large number of smaller tiles is not required.

A simulated wood exposure 14 can be molded onto the face side 2 of the tile 1 to simulate the look of wooden shingles or shakes, thereby offering an alternative to actual wooden shingles or shakes that does not carry the attendant fire hazard of those wooden roofing materials. In a most preferred embodiment, such simulated wood grain only is formed on a portion of the tile, with the remainder of the upper face 2 of the tile 1 being left to form a plain textured headlap. In alternative embodiments, the top surface can be glazed to present a glossy appearance or a dull surface such as terra cotta or slate or verdigris, or a metallic layer can be adhered to present a bright metallic finish.

In installation, there is no need for a different embodiment of the tile to be laid down as the first course closest to the eaves. The installer must, however either build a raised fascia or lay down a 1 inch by 2 inch board or two 1 inch by 2 inch boards, or use some other suitable construction technique sufficient to provide approximately a one and a half inch raised lip running parallel to the edge of the underlayment. The tiles themselves are laid down much as prior art tiles in conventional courses, and a suitable type of cap or cornice material is installed at the apex of the roof.

Figure 4:
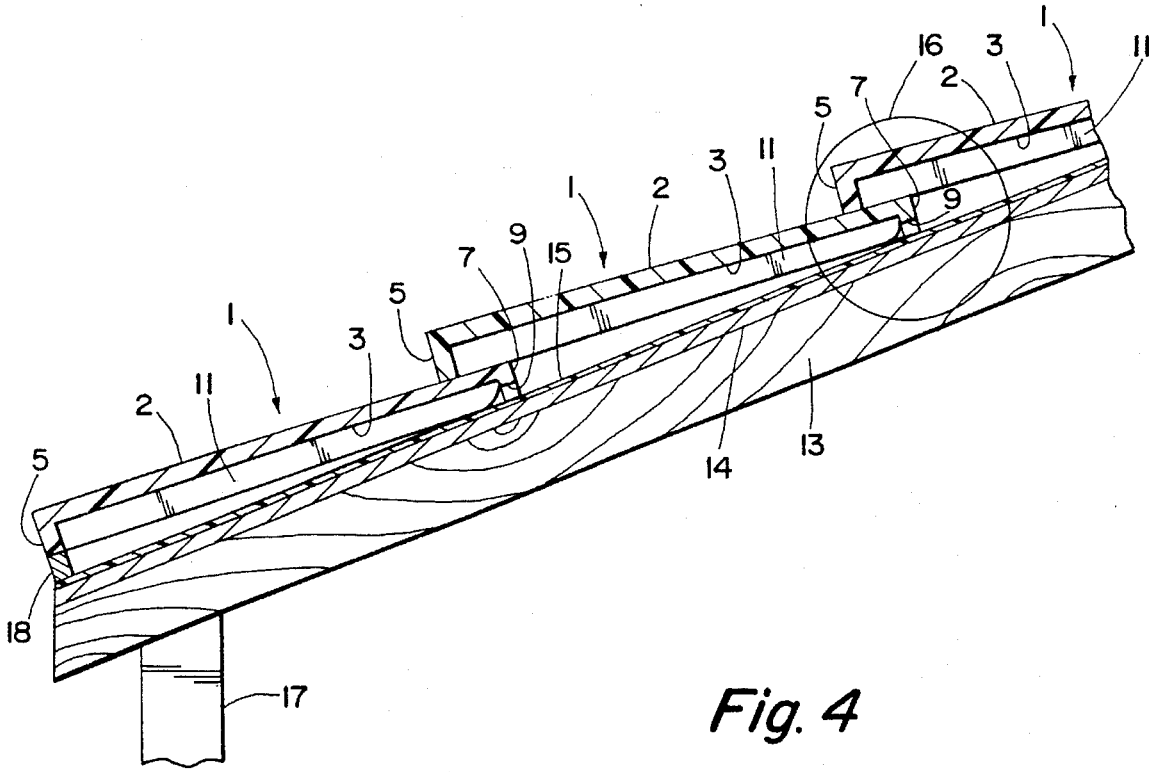
FIG. 4 is a cross-sectional view of a part of a roof constructed in accordance with the present invention, showing two courses of tiles laid onto a house structure and how the tiles overlap each other.
Figure 5:
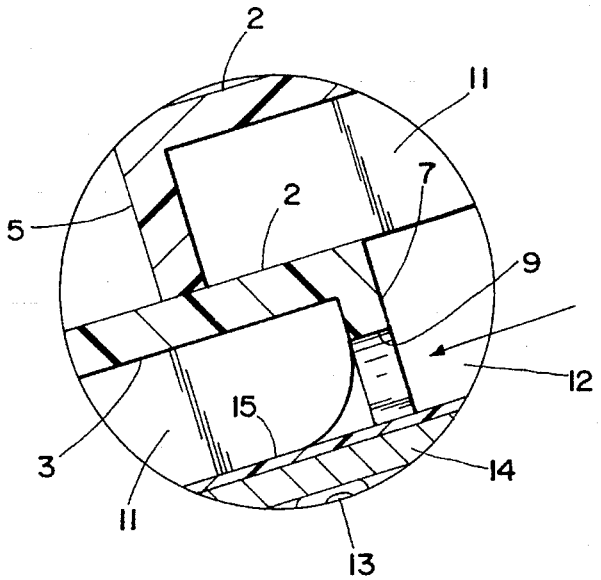
FIG. 5 is an enlargement of a detail from FIG. 4, showing in cross section the drainage slot and the direction of water flow through the slot.

Upon correct installation, the roofing tile of the invention creates a drainage system on the roof that allows water that would ordinarily dam up at the rear of the tiles to port through the entire system down to the eaves to be conducted away by whatever type of gutter system may be installed there, as depicted in FIGS. 4 and 5. FIG. 4 shows a rafter 13 supporting layers of underlayment material 14 and 15, which may be plywood and asphalt paper or the like, and shows two courses of tiles, the second course installed over the first course. FIG. 5 is an enlargement that shows detail of the slot 9 allowing the passage of water in direction 12. As it rains, water passes along direction 12 through slot 9, under tile 1 and downwards until it reaches the top flange of the next lower course of tiles, where the water then passes through the slot 9 of the next lower course of tiles. This process continues until the water reaches the end of the roof underlayment material. Water does not dam at the bottom flange of the first course of tiles since the bottom flange of the first course of tiles is raised on a built-up lip 18 as described in the previous paragraph.

While tile invention has been described and illustrated with reference to certain preparative embodiments thereof, those skilled in the art will appreciate that various changes, modifications and substitutions can be made therein without departing from the spirit and scope of the invention. It is intended, therefore, that the invention be limited only by the scope of the claims which follow, and that such claims be interpreted as broadly as possible.

What is claimed is:

1. A molded roofing tile, comprising:

(a) a planar panel having a face side and an under side;

(b) a bottom flange angularly juxtaposed adjacent said panel;

(c) a top flange angularly juxtaposed adjacent said panel, which top flange defines a single elongated drainage slot which is substantially parallel to the plane of said panel said slot elongated with respect to the length of said top flange;

(d) a first side flange angularly juxtaposed adjacent said panel, which first side flange is molded so as to form an over fitting rabbet;

(e) a second side flange angularly juxtaposed adjacent said panel, which first side flange is molded so as to form an under fitting rabbet;

(f) a single support rib fixably attached to the under side of said panel, beginning substantially at said top flange and terminating substantially at said bottom flange;

(g) said tiles being laid out on a roof by being affixed by suitable mechanical non-adhesive fastening means to a suitable underlayment means in courses, each tile's over fitting rabbet being juxtaposed adjacent to and interlocking with an under fitting rabbet of an adjacent tile.

2. The roofing tile as claimed in claim 1, wherein said drainage slot has a predetermined length that is a dimension that is at least 50% of the dimension of the width of said panel.

3. The roofing tile as claimed in claim 1, wherein said drainage slot has a predetermined length that is a dimension that is at least 75% of the dimension of the width of said panel.

4. The roofing panel as claimed in claim 1, wherein said panel, top flange, bottom flange, first side flange and second side flange form a substantially contiguous rectangular box-like structure having four corners on the underside of said panel.

5. The roofing tile as claimed in claim 4, additionally comprising at least two fastening means support posts, which are each fixably attached onto the underside of said panel at the comers formed by the intersection of said top flange and each of said first and second side flanges, said fastening means support posts defining bores of predetermined diameter for receiving suitable mechanical fastening means to attach said tile to a suitable underlayment of a roof structure.

6. The roofing tile as claimed in claim 1, additionally comprising a simulated wood grain textured surface molded into the face side of said tile.

7. The roofing tile as claimed in claim 1, wherein said support rib has a width dimension that is substantially the same as the greatest width dimension of any of said flanges.

8. A substantially box-like molded roofing tile, comprising:

(a) a planar panel having a face side and an under side;

(b) a bottom flange fixably attached to and angularly juxtaposed adjacent said panel;

(c) a top flange fixably attached to and angularly juxtaposed adjacent said panel, which top flange defines a single elongated drainage slot which is substantially parallel to the plane of said panel, said slot elongated with respect to the length of said top flange, said slot so defined by said top flange so as to present no barrier to the downward flow of water along the length of said slot;

(d) a first side flange fixably attached to and angularly juxtaposed adjacent said panel, which first side flange is molded so as to form an over fitting rabbet;

(e) a second side flange fixably attached to and angularly juxtaposed adjacent said panel, which first side flange is molded so as to form an under fitting rabbet;

(f) a single support rib fixably attached to the under side of said panel, beginning at said, top flange and terminating at said bottom flange which support rib's width is substantially the same as the greatest width of any of said flanges;

(g) at least two fastening means support posts, which are each fixably attached onto the underside of said panel at the corners formed by the intersection of said top flange and each of said first and second side flanges, said fastening means support posts defining bores of predetermined diameter for receiving suitable mechanical fastening means to attach said tile to a suitable underlayment of a roof structure;

(h) said tiles being laid out on a roof by being affixed by suitable mechanical non-adhesive fastening means to a suitable underlayment means in courses, each tile's over fitting rabbet being juxtaposed adjacent to and interlocking with an under fitting rabbet of an adjacent tile.

9. A method of installing roofs that are resistant to moisture-induced material failure, comprising the steps of:

(a) installing a suitable roofing underlayment material; and (b) using suitable mechanical non-adhesive fastener means, affixing onto said underlayment material a first and all subsequent needed courses of roofing tiles that have; a planar panel having a face side and an under side; a bottom flange angularly juxtaposed adjacent said panel; a top flange angularly juxtaposed adjacent said panel, which top flange defines a single elongated drainage slot which is substantially parallel to the plane of said panel said slot elongated with respect to the length of said top flange; a first side flange angularly juxtaposed adjacent said panel, which first side flange is molded so as to form an over fitting rabbet; a second side flange angularly juxtaposed adjacent said panel, which first side flange is molded so as to form an under fitting rabbet; a single support rib fixably attached to the under side of said panel, beginning substantially at said top flange and terminating substantially at said bottom flange; said tiles being laid out on said roof by being affixed by said mechanical fastening means to said suitable underlayment means in courses, each tile's over fitting rabbet being juxtaposed adjacent to and interlocking with an under fitting rabbet of an adjacent tile.

* * * * *